US008726941B2

(12) United States Patent
Dykstra

(10) Patent No.: US 8,726,941 B2
(45) Date of Patent: May 20, 2014

(54) EXIT ASSEMBLY HAVING A FLUID DIVERTER THAT DISPLACES THE PATHWAY OF A FLUID INTO TWO OR MORE PATHWAYS

(71) Applicant: Halliburton Energy Services, Inc., Houston, TX (US)

(72) Inventor: Jason D. Dykstra, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/657,441

(22) Filed: Oct. 22, 2012

(65) Prior Publication Data

US 2013/0126027 A1 May 23, 2013

Related U.S. Application Data

(63) Continuation of application No. PCT/US2011/061811, filed on Nov. 22, 2011.

(51) Int. Cl.
*F15D 1/02* (2006.01)

(52) U.S. Cl.
USPC ..... 138/39; 166/223

(58) Field of Classification Search
USPC ..... 138/39; 166/223
See application file for complete search history.

(56) References Cited

U.S. PATENT DOCUMENTS 2,037,940 A * 4/1936 Stalker ..... 138/39
2,813,708 A * 11/1957 Frey ..... 165/9.3
3,113,593 A * 12/1963 Vicard ..... 138/39
3,212,515 A * 10/1965 Zisfein et al. ..... 137/823
3,566,900 A 3/1971 Black
3,586,104 A 6/1971 Hyde
3,597,166 A * 8/1971 Hochman ..... 422/220
3,620,238 A 11/1971 Kawabata (Continued)

FOREIGN PATENT DOCUMENTS

WO WO 2010053378 A2 5/2010
WO WO 2010087719 A1 8/2010

(Continued)

OTHER PUBLICATIONS

Angrist, Fluid Control Devices, Scientific American, Dec. 1964, pp. 80-88, USA.

(Continued)

*Primary Examiner* — James Hook
(74) *Attorney, Agent, or Firm* — Scott F. Wendorf; Sheri Higgins Law; Sheri Higgins

(57) ABSTRACT

An exit assembly comprises: a fluid inlet; an exit chamber; a fluid outlet; and a fluid diverter, wherein the fluid diverter is connected to the fluid inlet and the exit chamber, and wherein the shape of the fluid diverter is selected such that the fluid diverter is capable of displacing the pathway of the fluid from the fluid inlet into a first fluid pathway, a second fluid pathway, or combinations thereof. The fluid diverter increasingly displaces the pathway of the fluid from the fluid inlet into the first fluid pathway as the viscosity or density of the fluid decreases, or as the flow rate of the fluid increases, and the fluid diverter increasingly displaces the pathway of the fluid from the fluid inlet into the second fluid pathway as the viscosity or density of the fluid increases, or as the flow rate of the fluid decreases.

22 Claims, 3 Drawing Sheets

(56) References Cited

U.S. PATENT DOCUMENTS

| | | | | |
|---|---|---|---|---|
| 3,712,321 | A | 1/1973 | Bauer | |
| 3,827,461 | A * | 8/1974 | Gilman | 138/39 |
| 3,955,362 | A * | 5/1976 | Jones et al. | 60/274 |
| 4,276,943 | A | 7/1981 | Holmes | |
| 4,323,991 | A | 4/1982 | Holmes et al. | |
| 4,418,721 | A | 12/1983 | Holmes | |
| 4,557,295 | A | 12/1985 | Holmes | |
| 4,714,522 | A * | 12/1987 | Holik | 162/264 |
| 4,895,582 | A | 1/1990 | Bielefeldt | |
| 4,989,807 | A * | 2/1991 | Foreman et al. | 244/53 B |
| 5,076,327 | A | 12/1991 | Mettner | |
| 6,497,252 | B1 | 12/2002 | Kohler et al. | |
| 6,722,422 | B1 * | 4/2004 | Feldmeier | 165/154 |
| 6,976,508 | B2 * | 12/2005 | Ueberall | 138/39 |
| 7,288,128 | B2 * | 10/2007 | Snyder | 55/418 |
| 7,828,067 | B2 | 11/2010 | Scott et al. | |
| 8,418,725 | B2 * | 4/2013 | Schultz | 137/820 |
| 2002/0089072 | A1 * | 7/2002 | Rock | 261/79.1 |
| 2004/0065375 | A1 * | 4/2004 | Snider | 138/39 |
| 2005/0173351 | A1 | 8/2005 | Neofotistos | |
| 2007/0107719 | A1 | 5/2007 | Blacker et al. | |
| 2008/0210325 | A1 * | 9/2008 | Aroussi | 138/39 |
| 2009/0120647 | A1 | 5/2009 | Turick et al. | |
| 2010/0249723 | A1 | 9/2010 | Fangrow, Jr. | |
| 2011/0042092 | A1 | 2/2011 | Fripp et al. | |
| 2011/0198097 | A1 | 8/2011 | Moen | |
| 2012/0234557 | A1 * | 9/2012 | Dykstra et al. | 166/373 |

FOREIGN PATENT DOCUMENTS

| | | |
|---|---|---|
| WO | WO 2011041674 A2 | 4/2011 |
| WO | WO 2011095512 A2 | 8/2011 |
| WO | WO 2011115494 A1 | 9/2011 |

OTHER PUBLICATIONS

Wright et al., The Development and Application of HT/HP Fiber Optic Connectors for Use on Subsea Intelligent Wells, OTC 15323, May 2003, pp. 1-8, For Presentation in 2003 OTC Conference in Houston, Texas, USA.

Freyer et al., An Oil Selective Inflow Control System, SPE 78272, Oct. 2002, pp. 1-8, for Presentation in 2002 SPE Conference in Aberdeen, Scotland, U.K.

* cited by examiner

EXIT ASSEMBLY HAVING A FLUID DIVERTER THAT DISPLACES THE PATHWAY OF A FLUID INTO TWO OR MORE PATHWAYS

CROSS-REFERENCE TO RELATED APPLICATION

This application claims priority to PCT Application No. PCT/US11/61811, filed on Nov. 22, 2011.

TECHNICAL FIELD

An exit assembly includes a fluid diverter that has a shape such that the fluid diverter is capable of displacing the pathway of a fluid from a fluid inlet into a first fluid pathway, a second fluid pathway, or combinations thereof. According to an embodiment, the fluid diverter increasingly displaces the pathway of the fluid from the fluid inlet into the first fluid pathway as the viscosity or density of the fluid decreases, or as the flow rate of the fluid increases, and the fluid diverter increasingly displaces the pathway of the fluid from the fluid inlet into the second fluid pathway as the viscosity or density of the fluid increases, or as the flow rate of the fluid decreases. The exit assembly can be used to regulate the flow rate of a fluid. In an embodiment, the exit assembly is used in a subterranean formation.

SUMMARY

According to an embodiment, an exit assembly comprises: a fluid inlet; an exit chamber; a fluid outlet, wherein the fluid outlet is located within the exit chamber; and a fluid diverter, wherein the fluid diverter is connected to the fluid inlet and the exit chamber, wherein a fluid is capable of flowing from the fluid inlet, through the fluid diverter, and into the exit chamber, and wherein the shape of the fluid diverter is selected such that the fluid diverter is capable of displacing the pathway of the fluid from the fluid inlet into a first fluid pathway, a second fluid pathway, or combinations thereof, wherein the first fluid pathway and the second fluid pathway are located within the exit chamber.

According to another embodiment, the fluid diverter increasingly displaces the pathway of the fluid from the fluid inlet into the first fluid pathway as the viscosity or density of the fluid decreases, or as the flow rate of the fluid increases, and the fluid diverter increasingly displaces the pathway of the fluid from the fluid inlet into the second fluid pathway as the viscosity or density of the fluid increases, or as the flow rate of the fluid decreases.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
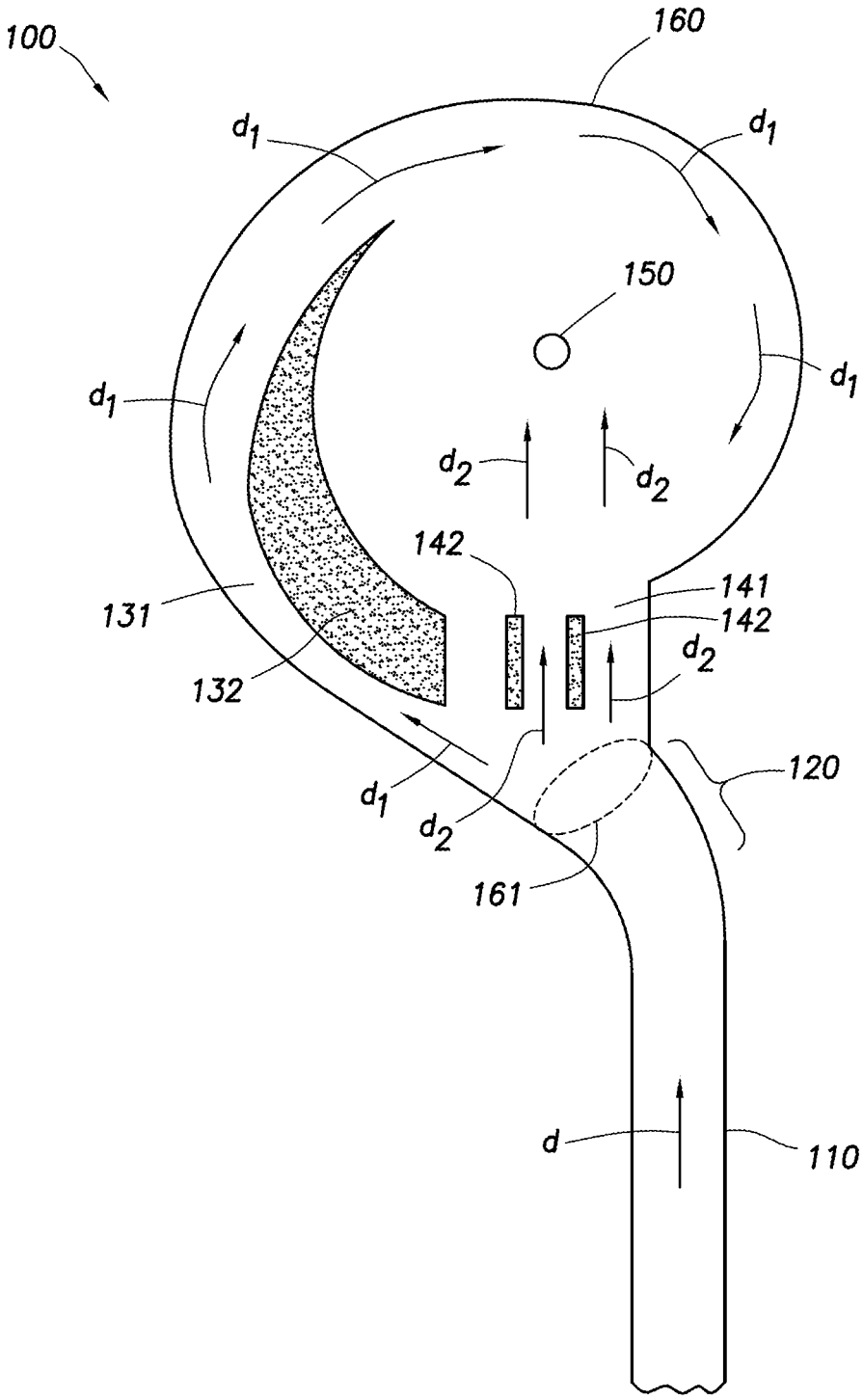
FIG. 1 is a diagram of an exit assembly according to an embodiment.

As used herein, the words "comprise," "have," "include," and all grammatical variations thereof are each intended to have an open, non-limiting meaning that does not exclude additional elements or steps.

It should be understood that, as used herein, "first," "second," "third," etc., are arbitrarily assigned and are merely intended to differentiate between two or more pathways, guides, etc., as the case may be, and does not indicate any particular orientation or sequence. Furthermore, it is to be understood that the mere use of the term "first" does not require that there be any "second," and the mere use of the term "second" does not require that there be any "third," etc.

As used herein, a "fluid" is a substance having a continuous phase that tends to flow and to conform to the outline of its container when the substance is tested at a temperature of 71° F. (22° C.) and a pressure of one atmosphere "atm" (0.1 megapascals "MPa"). A fluid can be a liquid or gas. A homogenous fluid has only one phase, whereas a heterogeneous fluid has more than one distinct phase. One of the physical properties of a fluid is its density. Density is the mass per unit of volume of a substance, commonly expressed in units of pounds per gallon (ppg) or kilograms per cubic meter (kg/$m^3$). Fluids can have different densities. For example, the density of deionized water is approximately 1,000 kg/$m^3$; whereas the density of crude oil is approximately 865 kg/$m^3$. Another physical property of a fluid is its viscosity. As used herein, the "viscosity" of a fluid is the dissipative behavior of fluid flow and includes, but is not limited to, kinematic viscosity, shear strength, yield strength, surface tension, viscoplasticity, and thixotropicity. Viscosity can be expressed in units of (force*time)/area. For example, viscosity can be expressed in units of dyne*s/$cm^2$ (commonly referred to as Poise (P)), or expressed in units of Pascals/second (Pa/s). However, because a material that has a viscosity of 1 P is a relatively viscous material, viscosity is more commonly expressed in units of centipoise (cP), which is 1/100 P.

Oil and gas hydrocarbons are naturally occurring in some subterranean formations. A subterranean formation containing oil or gas is sometimes referred to as a reservoir. A reservoir may be located under land or off shore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir.

A well can include, without limitation, an oil, gas, or water production well, or an injection well. Fluid is often injected into a production well as part of the construction process or as part of the stimulation process. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region.

During production operations, it is common for an undesired fluid to be produced along with a desired fluid. For example, water production is when water (the undesired fluid) is produced along with oil or gas (the desired fluid). By way of another example, gas may be the undesired fluid while oil is the desired fluid. In yet another example, gas may be the desired fluid while water and oil are the undesired fluids. It is beneficial to produce as little of the undesired fluid as possible.

During enhanced recovery operations, an injection well can be used for water flooding. Water flooding is where water is injected into the reservoir to displace oil or gas that was not produced during primary recovery operations. The water from the injection well physically sweeps some of the remaining oil or gas in the reservoir towards a production well. The enhanced recovery operations may also inject steam, carbon dioxide, acids, or other fluids into the reservoir.

In addition to the problem of undesired fluid production during recovery operations, the flow rate of a fluid from a subterranean formation into a wellbore may be greater than desired. For an injection well, potential problems associated with enhanced recovery techniques can include inefficient recovery due to variable permeability in a subterranean formation and a difference in flow rates of a fluid from the injection well into the subterranean formation. A fluid regulator can be used to help overcome some of these problems.

A fluid regulator can be used to variably restrict the flow rate of a fluid. A fluid regulator can also be used to regulate production of a fluid based on some of the physical properties of the fluid, for example, its density or viscosity.

A novel exit assembly includes a fluid diverter that has a shape such that the fluid diverter can displace the pathway of a fluid from a fluid inlet into two or more fluid pathways. The pathway of the fluid can be displaced based on at least the viscosity, density, and/or flow rate of the fluid.

The exit assembly can be used as a fluid regulator. Applications for the exit assembly are not limited to oilfield applications. As such, other applications where the exit assembly may be used include, but are not limited to, pipelines, chemical plants, oil refineries, food processing, and automobiles.

According to an embodiment, an exit assembly comprises: a fluid inlet; an exit chamber; a fluid outlet, wherein the fluid outlet is located within the exit chamber; and a fluid diverter, wherein the fluid diverter is connected to the fluid inlet and the exit chamber, wherein a fluid is capable of flowing from the fluid inlet, through the fluid diverter, and into the exit chamber, and wherein the shape of the fluid diverter is selected such that the fluid diverter is capable of displacing the pathway of the fluid from the fluid inlet into a first fluid pathway, a second fluid pathway, or combinations thereof, wherein the first fluid pathway and the second fluid pathway are located within the exit chamber.

According to another embodiment, the fluid diverter increasingly displaces the pathway of the fluid from the fluid inlet into the first fluid pathway as the viscosity or density of the fluid decreases, or as the flow rate of the fluid increases, and the fluid diverter increasingly displaces the pathway of the fluid from the fluid inlet into the second fluid pathway as the viscosity or density of the fluid increases, or as the flow rate of the fluid decreases.

The fluid can be a homogenous fluid or a heterogeneous fluid.

Figure 2:
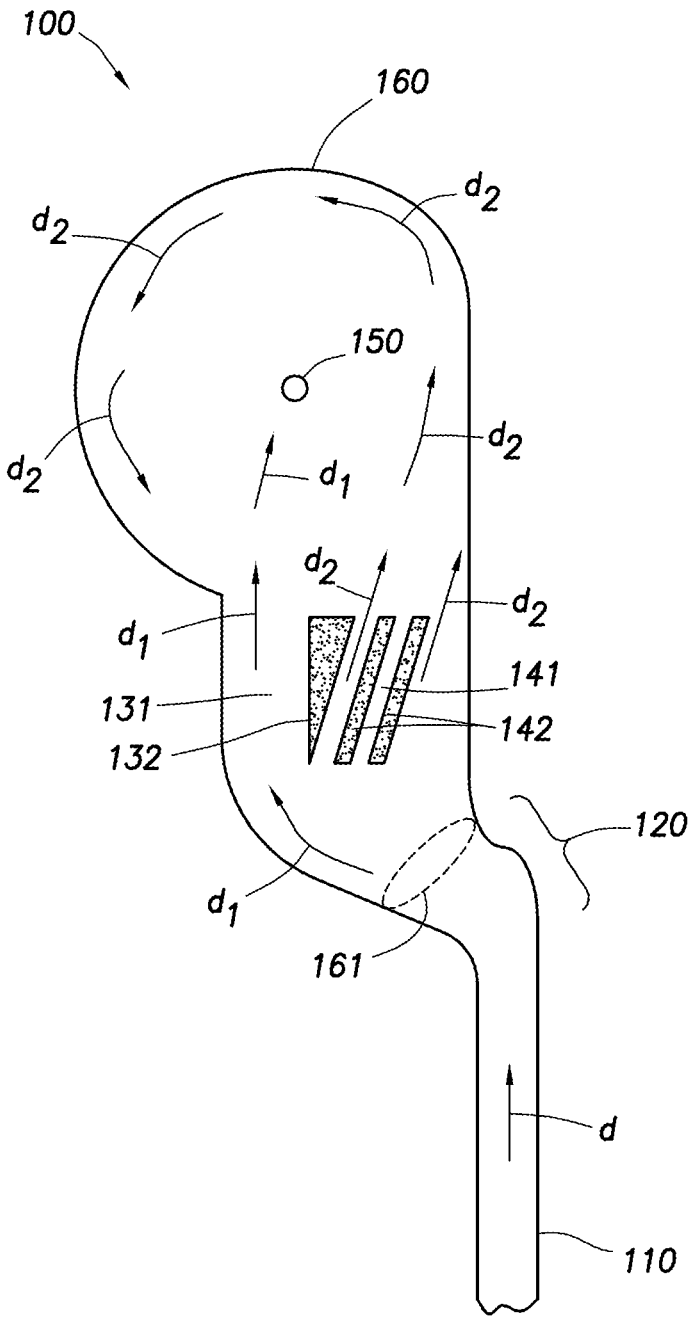
FIG. 2 is a diagram of an exit assembly according to another embodiment.

Turning to the Figures, FIG. 1 is a diagram of the exit assembly 100 according to an embodiment. FIG. 2 is a diagram of the exit assembly 100 according to another embodiment. The exit assembly 100 includes a fluid inlet 110, a fluid diverter 120, and an exit chamber 160. The fluid diverter 120 is connected to the fluid inlet 110 and the exit chamber 160. The fluid inlet 110 can be operatively connected to the exit chamber 160. By way of example, the fluid inlet 110 can be operatively connected to the exit chamber 160 via the fluid diverter 120. A fluid is capable of flowing from the fluid inlet 110, through the fluid diverter 120, and into the exit chamber 160. The exit chamber 160 can include an exit chamber entrance 161. The exit chamber entrance 161 can be located at the position where the fluid diverter 120 connects to the exit chamber 160. In this manner, as the fluid flows from the fluid inlet 110 in a direction d, the fluid can then flow through the fluid diverter 120 unobstructed (i.e., no object(s) exists within the fluid diverter that can obstruct, block, partially block, or otherwise alter or impede the flow or flow path of the fluid through the fluid diverter), and enter the exit chamber 160 via the exit chamber entrance 161.

The fluid inlet 110 can be a variety of shapes, so long as fluid is capable of flowing through the fluid inlet 110. By way of example, the fluid inlet 110 can be tubular, rectangular, pyramidal, or curlicue in shape. There can be more than one fluid inlet. For example, there can be a second fluid inlet (not shown). The fluid inlets can be arranged in parallel. According to an embodiment, any additional fluid inlets conjoin with the fluid inlet 110 at a point downstream of the fluid diverter 120. In this manner, any fluid flowing through the additional inlets will conjoin with the fluid flowing through the fluid inlet 110. The conjoined fluids can then flow in the direction d towards the fluid diverter 120.

The fluid diverter 120 can be a variety of shapes, and can also include combinations of various shapes. For example, the fluid diverter 120 can have curved walls, straight walls, and combinations thereof. The fluid diverter 120 can include straight sections, curved sections, angled sections, and combinations thereof. The fluid diverter 120 can be tubular, rectangular, pyramidal, or curlicue in shape. According to an embodiment, the shape of the fluid diverter 120 is selected such that the fluid diverter 120 is capable of displacing the pathway of the fluid from the fluid inlet 110 into a first fluid pathway 131, a second fluid pathway 141, or combinations thereof, wherein the first fluid pathway 131 and the second fluid pathway 141 are located within the exit chamber 160. According to another embodiment, the fluid diverter 120 increasingly displaces the pathway of the fluid from the fluid inlet 110 into the first fluid pathway 131 as the viscosity or density of the fluid decreases, or as the flow rate of the fluid increases, and the fluid diverter 120 increasingly displaces the pathway of the fluid from the fluid inlet 110 into the second fluid pathway 141 as the viscosity or density of the fluid increases, or as the flow rate of the fluid decreases. According to yet another embodiment, the fluid diverter 120 has a shape such that the fluid diverter 120 increasingly displaces the pathway of the fluid from the fluid inlet 110 into the first fluid pathway 131 as the viscosity or density of the fluid decreases, or as the flow rate of the fluid increases, and the fluid diverter 120 increasingly displaces the pathway of the fluid from the fluid inlet 110 into the second fluid pathway 141 as the viscosity or density of the fluid increases, or as the flow rate of the fluid decreases. The overall dimensions of the fluid diverter 120 can also be used in conjunction with the shape of the fluid diverter 120 to achieve the pathway displacement of the fluid.

According to an embodiment, and as shown in FIG. 1, the fluid flowing in the first fluid pathway 131 can enter the exit chamber 160 via the exit chamber entrance 161 in a first direction $d_1$, and the fluid flowing in the second fluid pathway 141 can enter the exit chamber 160 in a second direction $d_2$. As can be seen in FIG. 1, the first direction $d_1$ can be a direction that is tangential relative to a radius of the fluid outlet 150. In this manner, the fluid, when entering the exit chamber 160 in the first direction $d_1$ via the first fluid pathway 131, can flow rotationally about the inside of the exit chamber 160. As can also be seen, the second direction $d_2$ can be a direction that is radial to the fluid outlet 150. In this manner, the fluid, when entering the exit chamber 160 in the second direction $d_2$ will flow through the exit chamber 160 in a relatively non-rotational direction.

The following is an example of one possible design of the assembly and use according to an embodiment as depicted in FIG. 1. The exit assembly 100 can be designed such that a higher viscosity or higher density fluid will tend to flow in an axial direction within the exit chamber 160 (e.g., the second direction $d_2$), while a lower viscosity or lower density fluid will tend to flow in a rotational direction about the exit chamber 160 (e.g., the first direction $d_1$). By way of example, during oil and gas operations, oil may be a desired fluid to produce; whereas water or gas may be an undesired fluid to produce. Assuming a constant flow rate, as oil is more viscous and more dense than both water and gas, the system can be designed such that oil will tend to flow into the second fluid pathway 141 in the second direction $d_2$. If water and/or gas starts being produced along with the oil, the overall viscosity and density of the heterogeneous fluid will decrease, compared to the viscosity and density of the oil alone. As the viscosity and density decreases, the fluid can increasingly flow into the first fluid pathway 131 in the first direction $d_1$. According to this example, the assembly can be designed to restrict the production of the less dense and less viscous water and/or gas and foster production of the more dense and more viscous oil.

According to another embodiment, and as shown in FIG. 2, the first direction $d_1$ can be a direction that is radial to the fluid outlet 150. In this manner, the fluid, when entering the exit chamber 160 in the first direction $d_1$ will flow through the exit chamber 160 in a relatively non-rotational direction. As can also be seen, the second direction $d_2$ can be a direction that is tangential relative to a radius of the fluid outlet 150. In this manner, the fluid, when entering the exit chamber 160 in the second direction $d_2$ via the second fluid pathway 141, can flow rotationally about the inside of the exit chamber 160.

The following is an example of one possible design of the assembly and use according to the other embodiment as depicted in FIG. 2. The exit assembly 100 can be designed such that a higher viscosity or higher density fluid will tend to flow in a rotational direction about the exit chamber 160 (e.g., the second direction $d_2$), while a lower viscosity or lower density fluid will tend to flow in an axial direction within the exit chamber 160 (e.g., the first direction $d_1$). By way of example, during oil and gas operations, gas may be a desired fluid to produce; whereas water may be an undesired fluid to produce. Assuming a constant flow rate, as gas is less viscous and less dense than water, the system can be designed such that gas will tend to flow into the first fluid pathway 131 in the first direction $d_1$. If water starts being produced along with the gas, the overall viscosity and density of the heterogeneous fluid will increase, compared to the viscosity and density of the gas alone. As the viscosity and density increases, the fluid can increasingly flow into the second fluid pathway 141 in the second direction $d_2$. According to this example, the assembly can be designed to restrict the production of the more dense and more viscous water and foster production of the less dense and less viscous gas.

The exit assembly 100 also includes the fluid outlet 150, wherein the fluid outlet 150 is located within the exit chamber 160. Preferably, the fluid outlet 150 is located near the center of the exit chamber 160. According to an embodiment, the fluid flowing in a direction axial to the fluid outlet 150 will flow towards the fluid outlet 150. In this manner, the fluid can exit the exit assembly 100 via the fluid outlet 150. According to another embodiment, the fluid flowing in a rotational direction, will flow about the fluid outlet 150. As the volume of fluid flowing in the rotational direction increases, the amount of back pressure in the system increases. Conversely, as the volume of fluid flowing in an axial direction increases, the amount of back pressure in the system decreases. As used herein, reference to the "back pressure in the system" means the pressure differential between the fluid inlet 110 and the fluid outlet 150.

According to an embodiment, as the fluid increasingly flows rotationally about the exit chamber 160, the resistance to flow of the fluid through the exit chamber 160 increases. According to another embodiment, as the fluid increasingly flows rotationally about the fluid outlet 150, the resistance to flow of the fluid through the fluid outlet 150 increases.

According to another embodiment, as the fluid increasingly flows through the exit chamber 160 in a direction axial to the fluid outlet 150, the resistance to flow of the fluid through the exit assembly 100 decreases. According to another embodiment, as the fluid increasingly flows through the exit chamber 160 in a direction axial to the fluid outlet 150, the resistance to flow of the fluid through the fluid outlet 150 decreases. Accordingly, a fluid entering the exit chamber 160 in an axial direction (compared to a fluid entering in a rotational direction) can experience: an axial flow through the exit chamber 160; less resistance to flow through the exit chamber 160; less backpressure in the system; and less of a resistance to exit the fluid outlet 150.

The exit assembly 100 can also include more than one fluid outlet (not shown). If the exit assembly 100 includes more than one fluid outlet, then the outlets can be arranged in a variety of ways. By way of example, all of the fluid outlets can be located near the center of the exit chamber 160. By way of another example, one or more outlets can be located near the center and one or more outlets can be located near the periphery of the exit chamber 160. Preferably at least one of the fluid outlets (e.g., the fluid outlet 150) is located near the center of the exit chamber 160. In this manner, at least some of the fluid flowing near the center can exit the exit assembly 100 via the outlets located near the center of the exit chamber 160. Moreover, if the exit chamber 160 includes one or more outlets located near the periphery of the exit chamber 160, then at least some of the fluid flowing near the periphery can exit the exit assembly 100 via the peripheral outlets.

The exit assembly 100 can also comprise a first fluid guide 132 and can also comprise a second fluid guide 142. The size and shape of the guides 132/142 can be selected to assist the fluid to continue flowing in the first fluid pathway 131 and/or the second fluid pathway 141. The location of the guides 132/142 can be designed to assist the fluid to continue flowing in the first fluid pathway 131 and/or the second fluid pathway 141. The size, shape, and/or location of the first fluid guide 132 can be selected to assist the fluid to flow in a rotational or axial direction with respect to the fluid outlet 150. By way of example, and as depicted in FIG. 1, the size, shape, and/or location of the first fluid guide 132 is selected such that any fluid flowing through the first fluid pathway 131 flows about the exit chamber 160 in a rotational direction (e.g., the first direction $d_1$). By way of another example, and as depicted in FIG. 2, the size, shape, and/or location of the first fluid guide 132 is selected such that any fluid flowing through the first fluid pathway 131 flows within the exit chamber 160 in an axial direction (e.g., the first direction $d_1$).

The size, shape, and/or location of the second fluid guide 142 can be selected to assist the fluid to flow in a rotational or axial direction with respect to the fluid outlet 150. By way of example, and as depicted in FIG. 1, the size, shape, and/or location of the second fluid guide 142 is selected such that any fluid flowing through the second fluid pathway 141 flows within the exit chamber 160 in an axial direction (e.g., the second direction $d_2$). By way of another example, and as depicted in FIG. 2, the size, shape, and/or location of the second fluid guide 142 is selected such that any fluid flowing through the second fluid pathway 141 flows about the exit chamber 160 in a rotational direction (e.g., the second direction $d_2$). Of course there can be more than one first fluid pathway 131 and also more than one first fluid guide 132. There can also be more than one second fluid pathway 141 and also more than one second fluid guide 142. If there is more than one first fluid guide 132, the first fluid guides do not have to be the same size or the same shape. If there is more than one second fluid guide 142, the second fluid guides do not have to be the same size or the same shape. Moreover, multiple shapes of guides 132/142 can be used within a given exit assembly 100.

As can be seen when comparing FIG. 1 to FIG. 2, a fluid having a higher viscosity, higher density, or lower flow rate will tend to flow into the second fluid pathway 141, while a fluid having a lower viscosity, lower density, or higher flow rate will tend to flow into the first fluid pathway 131. The viscosity, density, or flow rate at which the fluid switches from one fluid pathway to the other fluid pathway (i.e., the switching point) can be pre-determined. By way of example, the pre-determined switching point can be a density of 800 $kg/m^3$. According to this example, a fluid having a density of less than 800 $kg/m^3$ will tend to flow into the first fluid pathway 131. As the density of the fluid increases begins to increase to 800 $kg/m^3$, the fluid will begin to switch pathways and increasingly flow into the second fluid pathway 141. It is to be understood that the switching point does not cause 100% of the fluid to flow into a different pathway at that switching point. But rather, as the property of the fluid or the flow rate of the fluid increases or decreases towards the switching point, the fluid will increasingly begin to flow into a different pathway. The fluid inlet 110 can also contain a biasing section. The biasing section can include straight portions, curved portions, angled portions, and combinations thereof. The biasing section can be designed such that as the fluid flows through the fluid inlet 110 towards the fluid diverter 120, the fluid is biased towards the first fluid pathway 131 or the second fluid pathway 141.

As can be seen when contrasting FIG. 1 with FIG. 2, the exit assembly 100 can be designed such that in one instance, the fluid flowing through the first fluid pathway 131 flows rotationally about the exit chamber 160 and in another instance, the fluid flowing through the first fluid pathway 131 flows axially within the exit chamber 160. Moreover, the exit assembly 100 can be designed such that in one instance, the fluid flowing through the second fluid pathway 141 flows axially within the exit chamber 160 and in another instance, the fluid flowing through the second fluid pathway 141 flows rotationally about the exit chamber 160. These variations can be used to foster production of a desired fluid, depending on the specifics for a particular operation. For example, the variations can be used to foster production of a desired fluid that has a different viscosity and density compared to an undesired fluid.

Figure 3:
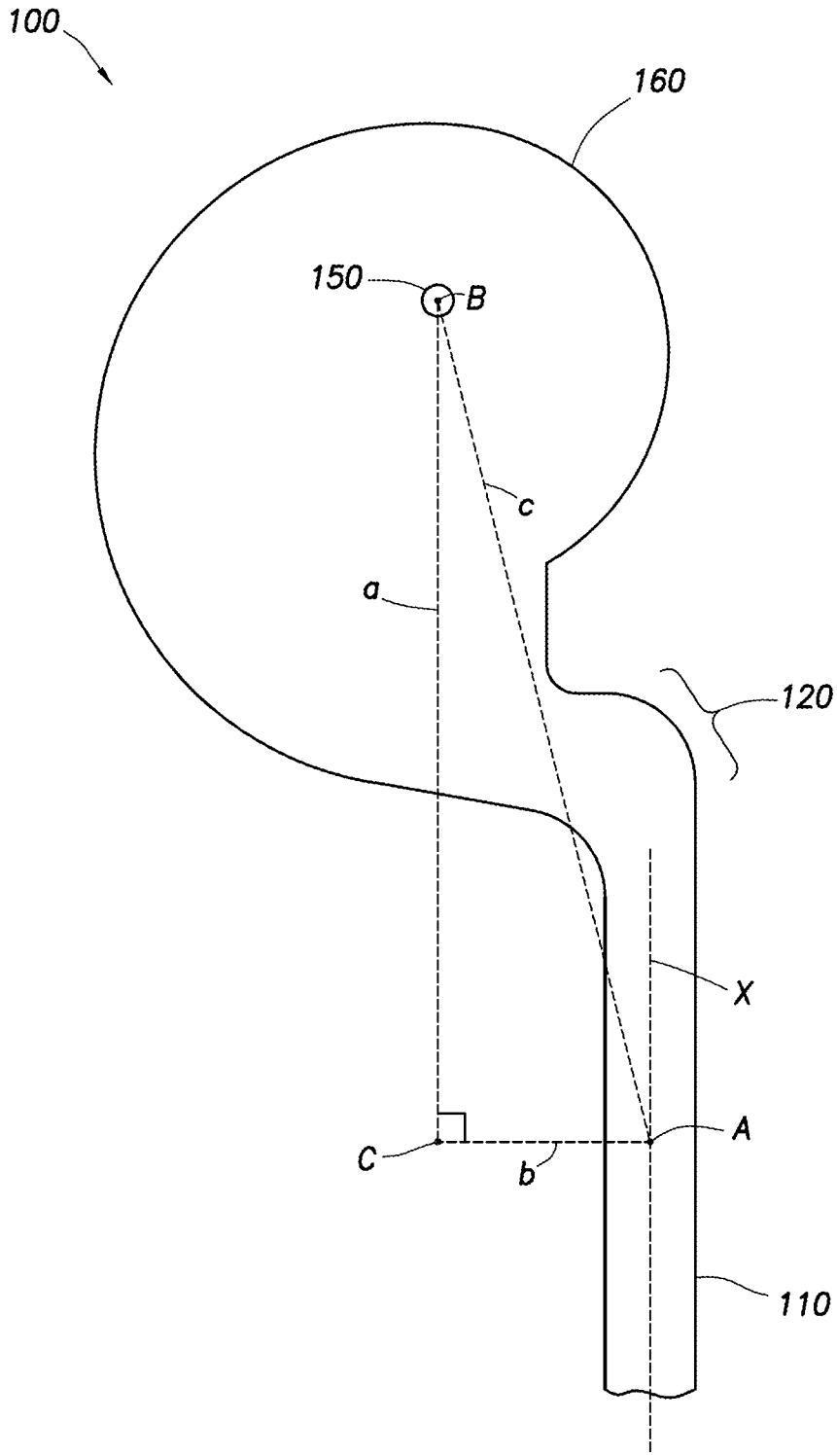
FIG. 3 illustrates one way to quantify the distance of offset of a fluid inlet from a fluid outlet.

According to an embodiment, the fluid inlet 110 is not in line with the fluid outlet 150. As can be seen in FIG. 3, the fluid inlet 110 can be offset from the fluid outlet 150 a certain distance. The distance of offset can vary. The distance of offset can be quantified by determining the length of leg b. The length of leg b can be determined using a right triangle. Leg b is formed between the vertex of angle C and the vertex of angle A and leg c is the hypotenuse. The right triangle includes leg a, wherein leg a extends from the fluid outlet 150 at the vertex of angle B down to the vertex of angle C. Angle C is 90°, but angle A and angle B can vary. The vertex of angle A is located at a desired point on axis X. Axis X is an axis in the center of the fluid inlet 110 that runs parallel to the direction d of fluid flow and can also be tangential to a portion of the outside of the exit chamber 160. According to an embodiment, leg a is parallel to axis X. However, regardless of the shape of the fluid inlet 110 at the desired point (e.g., curved, angled, or straight), and hence the shape of axis X, leg a extends down from the vertex of angle B such that a right triangle is formed at angle C.

The distance of offset can be used to help bias the fluid to flow into the first fluid pathway 131 or the second fluid pathway 141. Moreover, the distance of offset can be used to set the switching point of fluid flow. By way of example, as the distance of offset decreases, the fluid can increasingly flow into the second fluid pathway 141. By contrast, as the distance of offset increases, the fluid can increasingly flow into the first fluid pathway 131. The distance of offset can be used alone, or can also be used in conjunction with the shape of the fluid diverter 120, to help dictate the flow path of the fluid.

According to an embodiment, the fluid diverter increasingly displaces the pathway of the fluid from the fluid inlet into the first fluid pathway as the viscosity or density of the fluid decreases, or as the flow rate of the fluid increases, and the fluid diverter increasingly displaces the pathway of the fluid from the fluid inlet into the second fluid pathway as the viscosity or density of the fluid increases, or as the flow rate of the fluid decreases. The shape of the exit chamber 160 can also be designed to work in tandem with the shape of the fluid diverter 120 such that, based on the aforementioned properties of the fluid, the fluid either increasingly flows into the first fluid pathway 131 or the second fluid pathway 141. Furthermore, the size, shape, and location of the guides 132/142 can be designed to work in tandem with the shape of the exit chamber 160 and the shape of the fluid diverter 120 to achieve the aforementioned results. Moreover, the distance of offset can be selected to work in tandem with the shape of the exit chamber 160, the shape of the fluid diverter 120, and/or the size, shape, and location of the guides 132/142.

The components of the exit assembly 100 can be made from a variety of materials. Examples of suitable materials include, but are not limited to: metals, such as steel, aluminum, titanium, and nickel; alloys; plastics; composites, such as fiber reinforced phenolic; ceramics, such as tungsten carbide, boron carbide, synthetic diamond, or alumina; elastomers; and dissolvable materials.

The exit assembly 100 can be used any place where the variable restriction or regulation of the flow rate of a fluid is desired. According to an embodiment, the exit assembly 100 is used in a subterranean formation. According to another embodiment, the subterranean formation is penetrated by at least one wellbore. An advantage for when the exit assembly 100 is used in a subterranean formation 20, is that it can help regulate the flow rate of a fluid. Another advantage is that the exit assembly 100 can help solve the problem of production of a heterogeneous fluid. For example, if oil is the desired fluid to be produced, the exit assembly 100 can be designed such that if water enters the exit assembly 100 along with the oil, then the exit assembly 100 can reduce the flow rate of the fluid exiting via the fluid outlet 150 based on the decrease in viscosity of the fluid. The versatility of the exit assembly 100 allows for specific problems in a subterranean formation to be addressed.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention. While compositions and methods are described in terms of "comprising," "containing," or "including" various components or steps, the compositions and methods also can "consist essentially of" or "consist of" the various components and steps. Whenever a numerical range with a lower limit and an upper limit is disclosed, any number and any included range falling within the range is specifically disclosed. In particular, every range of values (of the form, "from about a to about b," or, equivalently, "from approximately a to b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. An exit assembly comprising:

a fluid inlet;

an exit chamber;

a fluid outlet, wherein the fluid outlet is located within the exit chamber; and a fluid diverter, wherein the fluid diverter is connected to the fluid inlet and the exit chamber, wherein a fluid is capable of flowing from the fluid inlet, through the fluid diverter, and into the exit chamber, wherein the fluid flows through the fluid diverter in an unobstructed manner, and wherein the shape of the fluid diverter is selected such that the fluid diverter is capable of displacing the pathway of the fluid from the fluid inlet into a first fluid pathway, a second fluid pathway, and combinations thereof, wherein the first fluid pathway and the second fluid pathway are located within the exit chamber, wherein the fluid flowing in the first fluid pathway flows within the exit chamber in a first direction and the fluid flowing in the second fluid pathway flows within the exit chamber in a second direction, wherein the first direction is in a rotational direction about the fluid outlet and the second direction is in a direction axial to the fluid outlet, and wherein the exit chamber is designed such that a higher viscosity, higher density, or lower flow rate fluid will flow in the second direction, while a lower viscosity, lower density, or higher flow rate fluid will flow in the first direction.

2. The assembly according to claim 1, wherein the fluid is a homogenous fluid or a heterogeneous fluid.

3. The assembly according to claim 1, wherein the fluid inlet is operatively connected to the exit chamber via the fluid diverter.

4. The assembly according to claim 1, wherein the exit chamber further comprises an exit chamber entrance.

5. The assembly according to claim 4, wherein the exit chamber entrance is located at the position where the fluid diverter connects to the exit chamber.

6. The assembly according to claim 1, wherein the fluid inlet is tubular, rectangular, pyramidal, or curlicue in shape.

7. The assembly according to claim 1, wherein the fluid diverter comprises straight sections, curved sections, angled sections, and combinations thereof.

8. The assembly according to claim 1, wherein the fluid diverter increasingly displaces the pathway of the fluid from the fluid inlet into the first fluid pathway as the viscosity or density of the fluid decreases, or as the flow rate of the fluid increases.

9. The assembly according to claim 1, wherein the fluid diverter increasingly displaces the pathway of the fluid from the fluid inlet into the second fluid pathway as the viscosity or density of the fluid increases, or as the flow rate of the fluid decreases.

10. The assembly according to claim 1, wherein the fluid flowing in the axial direction will flow towards the fluid outlet.

11. The assembly according to claim 1, wherein the fluid flowing in the rotational direction will flow about the fluid outlet.

12. The assembly according to claim 1, wherein the assembly further comprises a first fluid guide and/or a second fluid guide.

13. The assembly according to claim 12, wherein the size and shape of the first and/or second fluid guides is selected to assist the fluid to continue flowing in the first fluid pathway and/or the second fluid pathway.

14. The assembly according to claim 1, wherein the fluid inlet is not in line with the fluid outlet.

15. The assembly according to claim 1, wherein the exit assembly is used in a subterranean formation.

16. An exit assembly comprising:

a fluid inlet;

an exit chamber;

a fluid outlet, wherein the fluid outlet is located within the exit chamber; and a fluid diverter, wherein the fluid diverter is connected to the fluid inlet and the exit chamber, wherein a fluid is capable of flowing from the fluid inlet, through the fluid diverter, and into the exit chamber, wherein the fluid flows through the fluid diverter in an unobstructed manner, and wherein the shape of the fluid diverter is selected such that the fluid diverter is capable of displacing the pathway of the fluid from the fluid inlet into a first fluid pathway, a second fluid pathway, and combinations thereof, wherein the first fluid pathway and the second fluid pathway are located within the exit chamber, wherein the fluid flowing in the first fluid pathway flows within the exit chamber in a first direction and the fluid flowing in the second fluid pathway flows within the exit chamber in a second direction, wherein the first direction is in a direction axial to the fluid outlet and the second direction is in a rotational direction about the fluid outlet, and wherein the exit chamber is designed such that a higher viscosity, higher density, or lower flow rate fluid will flow in the second direction, while a lower viscosity, lower density, or higher flow rate fluid will flow in the first direction.

17. The assembly according to claim 16, wherein the fluid diverter increasingly displaces the pathway of the fluid from the fluid inlet into the first fluid pathway as the viscosity or density of the fluid decreases, or as the flow rate of the fluid increases.

18. The assembly according to claim 16, wherein the fluid diverter increasingly displaces the pathway of the fluid from the fluid inlet into the second fluid pathway as the viscosity or density of the fluid increases, or as the flow rate of the fluid decreases.

19. The assembly according to claim 16, wherein the fluid flowing in the axial direction will flow towards the fluid outlet.

20. The assembly according to claim 16, wherein the fluid flowing in the rotational direction will flow about the fluid outlet.

21. The assembly according to claim 16, wherein the assembly further comprises a first fluid guide and/or a second fluid guide.

22. The assembly according to claim 21, wherein the size and shape of the first and/or second fluid guides is selected to assist the fluid to continue flowing in the first fluid pathway and/or the second fluid pathway.

* * * * *